US006434921B2

(12) United States Patent
Premi

(10) Patent No.: US 6,434,921 B2
(45) Date of Patent: Aug. 20, 2002

(54) METHOD FOR THE PNEUMATIC SPLICING OF THREADS OR YARNS CONTAINING AN ELASTOMER AND DEVICE FOR PERFORMING SAID SPLICING

(75) Inventor: Mauro Premi, Brescia (IT)

(73) Assignee: Mesdan S.p.A., Brescia (IT)

( * ) Notice: Subject to any disclaimer, the term of this patent is extended or adjusted under 35 U.S.C. 154(b) by 0 days.

(21) Appl. No.: 09/728,311

(22) Filed: Dec. 1, 2000

(30) Foreign Application Priority Data

Dec. 10, 1999 (IT) ..... MI99A2562

(51) Int. Cl.[7] ..... D01H 15/00
(52) U.S. Cl. ..... 57/23; 57/261
(58) Field of Search ..... 57/22, 23, 261, 57/263, 262

(56) References Cited

U.S. PATENT DOCUMENTS 4,481,761 A * 11/1984 Kimura ..... 57/22
4,653,258 A * 3/1987 Rohner ..... 57/22
4,738,093 A * 4/1988 Zumfeld et al. ..... 57/22
4,796,418 A * 1/1989 Rebsamen et al. ..... 57/22
5,155,987 A * 10/1992 Vogel ..... 57/22
5,479,769 A * 1/1996 Belloy et al. ..... 57/22
5,680,751 A * 10/1997 Premi ..... 57/22

* cited by examiner

*Primary Examiner*—Danny Worrell
(74) *Attorney, Agent, or Firm*—Hedman & Costigan, P.C.

(57) ABSTRACT

A method for the pneumatic splicing of threads or yarns containing an elastomer comprises, in sequence, at least the following phases: introduction in a splicing chamber (11), belonging to a splicing device **(10, 10*a*, 10*b*, 10*c*), of the ends of the threads (12, 15) to be spliced together; a first input of one or more jets of compressed air into the splicing chamber (11) to perform a first interlacing of the threads (12, 15); cutting of the ends of the threads (12, 15), with scissors (18, 19), after the first input of air; a second input of one or more jets of compressed air into the splicing chamber (11) to complete the splicing of the cut ends of the threads (12, 15) and release of the spliced thread with the return of all the parts of the splicing device (10, 10*a*, 10*b*, 10*c*)** to their original position.

5 Claims, 4 Drawing Sheets

10b

METHOD FOR THE PNEUMATIC SPLICING OF THREADS OR YARNS CONTAINING AN ELASTOMER AND DEVICE FOR PERFORMING SAID SPLICING

BACKGROUND OF THE INVENTION

The present invention concerns a method for the pneumatic splicing of threads or yarns containing an elastomer.

The present invention also concerns a device for the pneumatic splicing of the above-mentioned threads or yarns containing an elastomer.

Splicing devices for textile yarns are known which make use of compressed air, commonly defined as air splicers.

These devices have guides to facilitate the introduction of the threads to be spliced, means for clamping and cutting the threads, means for preparing the ends, means for withdrawing the cut threads in the direction of the chamber and a chamber created in a body and provided with a longitudinal slot for introducing and extracting the threads, wherein there are one or more holes or nozzles for injecting compressed air. In these devices, splicing of the threads is performed by means of the following operations, after having introduced into the device, and in particular into the splicing chamber, the ends of the threads to be spliced.

Firstly the threads are clamped and cut, after which the ends of the thread are opened, thus removing the twisting of the threads, by means of compressed air, and the ends of the thread are withdrawn in the direction of the chamber.

At this point the threads, with their fibres opened and lying parallel, are partly overlapping, one next to the other, and are then subjected to one or more jets of compressed air in the splicing chamber to perform the actual splicing. Finally the thread thus spliced is released and all the parts of the splicing device return to their original position.

On this subject it must be noted that, in recent years, yarns with a cut fibre containing an elastomer have become increasingly common on the market.

These yarns are usually made with techniques known as "core-spun" and, applying certain precautions, such as the use of suitably labyrinths, they may be spliced with the technique described above, even if the elastomers contained in each of the two threads to be spliced cannot be interlaced with each other because of their single-filament nature. Another problem in splicing thread containing elastomer lies in the fact that, at the time of cutting the thread, the elastomer in the thread tends to shrink back due to its elasticity which is much greater than that of the spun fibres that surround it.

As a result, usually, splicing is performed on a piece of thread without elastomer and the spliced part remains without elasticity.

SUMMARY OF THE INVENTION

The aim of the present invention is, therefore, to provide a method and a device which allow splicing to be obtained in which the elastomers of the two ends of the thread to be spliced are incorporated.

This and other aims are achieved by a method for pneumatically splicing two threads or two yarns containing an elastomer, said method comprising the sequence of the following steps:

(a) introducing ends of said threads or yarns to be spliced into a splicing chamber (11), of a splicing device **(10, 10*a*, 10*b*, 10*c*)**;

(b) inputing compresssed air by a first input of one or more jets of compressed air into said splicing chamber (11) to cause a first interlacing of said threads or yarns;

(c) cutting the ends of said threads or yarns with scissors (18, 19), after the said first input of compressed air to form threads or yarns having cut ends;

(d) inputing into said splicing chamber (11) a second input of one or more jets of compressed air to complete the splicing of said threads or yarns having cut ends and form a spliced thread or yarn;

releasing said spliced thread from said splicing device **(10, 10*a*, 10*b*, 10*c*)**.

These aims are also achieved by a device for the pneumatic splicing of two threads or two yarns containing an elastomer, said device comprising a splicing chamber (11) having one or more holes or nozzles for injecting compressed air, a pair of suction ports (14, 17), each for one of said threads or yarns to be spliced, cutting means (18, 19) for said thread or yarns comprising at least one pair of clamping means using clamps (20, 21, or 22, 23) for clamping said ends of the threads or yarns to be spliced.

Further characteristics of the present invention are also defined in the subsequent claims.

Further aims and advantages of the present invention will be clearly understood from the following description and from the enclosed drawings, supplied purely as an explanatory example without limitation, in which:

BRIEF DESCRIPTIONS OF THE DRAWINGS

DETAILED DESCRIPTION OF THE INVENTION

Figure 1:
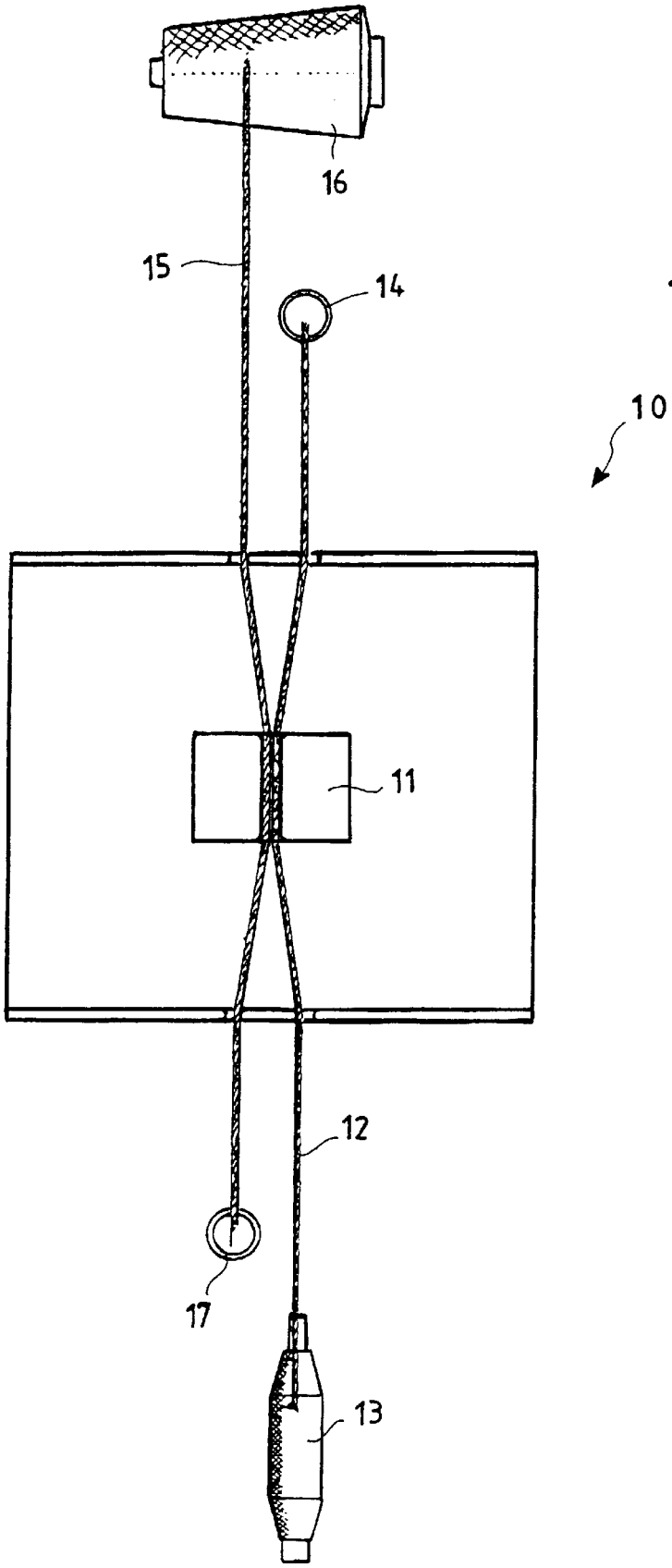
FIG. 1 shows a schematic view of the phase of introducing the threads into the splicing device, according to the present invention.

With particular reference to FIG. 1, the device for the pneumatic splicing of threads or yarns containing an elastomer, according to the present invention, is globally indicated with the reference number 10.

In particular, the device 10 presents a splicing chamber 11, inside which jets of compressed air may be fed by means of suitable nozzles (not shown), A first thread 12, coming from a spool 13, is passed through the splicing chamber 11 until it is held in position, on the opposite side of the splicing chamber 11, by a first suction port 14.

Vice versa a second thread 15, coming from a reel 16, is passed through the splicing chamber 11 until it is held in position, on the opposite side of the splicing chamber 11, by a second suction port 17.

Figure 2:
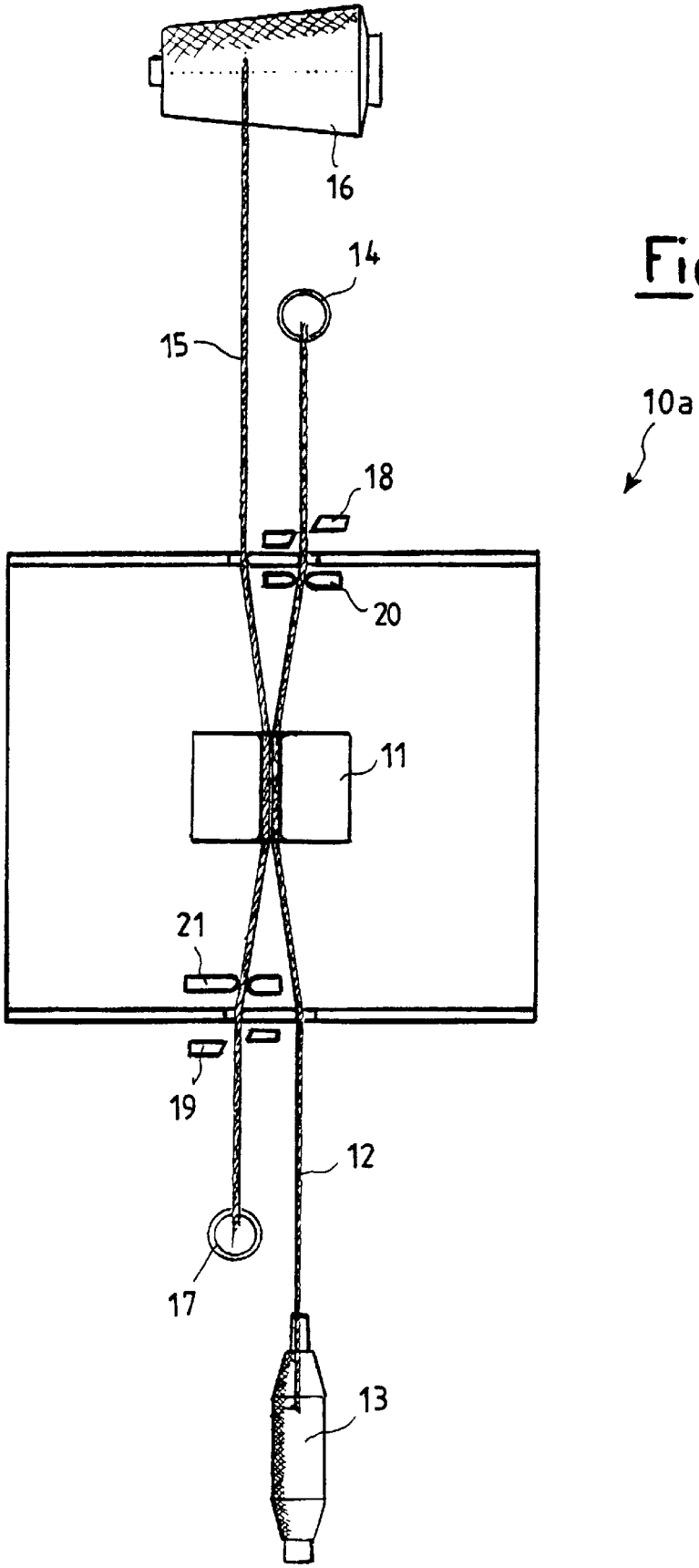
FIG. 2 shows a schematic view of a first preferred variation of the splicing method according to the present invention.

FIG. 2 shows a schematic view of a first preferred variation of the splicing method according to the present invention, globally indicated with the reference number **10*a***.

In this device **10*a* there are scissors 18 for cutting the tail of the first thread 12, and scissors 19 for cutting the tail of the second thread 15**.

There is also a clamp 20 for clamping the tail of the first thread 12, and a clamp 21 for clamping the tail of the second thread 15.

With reference to FIG. 2, the operative sequence for the first embodiment of the invention method is as follows: firstly the ends of the threads 12 and 15, to be spliced together, are inserted in the device 10*a*.

Next the two ends of the tails of the threads 12 and 15 to be spliced are clamped by activating the clamps 20 and 21.

At this point a first interlacing is performed with one or more jets of compressed air in the splicing chamber 11, after which the ends of the threads 12 and 15 are cut.

Then, with one or more jets of compressed air in the splicing chamber 11, splicing of the cut ends is completed.

Finally the spliced thread is released and all the parts of the device return to their original position.

Figure 3:
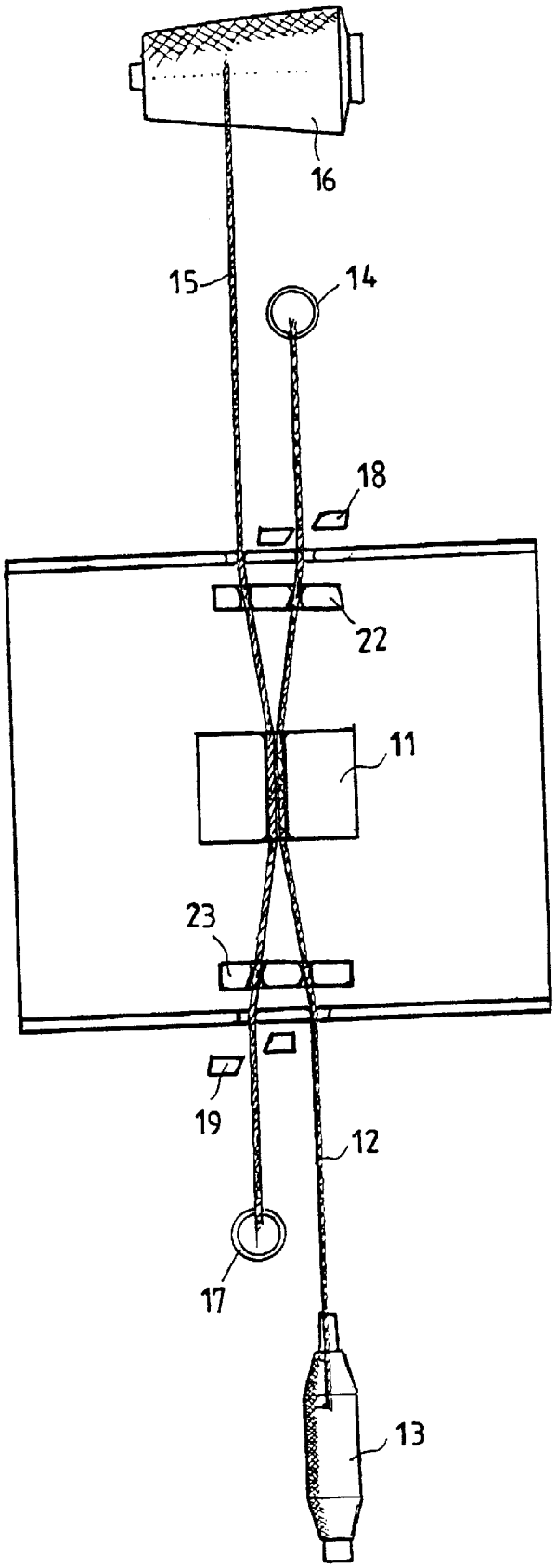
FIG. 3 shows a schematic view of a second preferred variation of the splicing method of the invention.

FIG. 3 shows a schematic view of a second preferred variation of the splicing device in the invention, globally indicated with the reference number 10*b*.

In this device 10*b*, unlike the device 10*a* previously described, there are, as well as the scissors 18 and 19, a clamp 22 for clamping simultaneously the end of the first thread 12 and the second thread 15, and a clamp 23 for clamping simultaneously the end of the second thread 15 and the first thread 12.

In this case, the operative sequence for this second embodiment of the invention method differs from the one just described because clamping, suitably realised in the immediate vicinity of the splicing chamber 11, involves on both sides of the chamber 11 both the thread coming in and the one going out of the chamber 11, by activating the clamps 22 and 23.

In this case too, in sequence, the following phases are performed: a first interlacing of the threads is performed with one or more jets of compressed air in the splicing chamber 11.

Next, the ends of the threads 12 and 15 are cut.

Then, with one or more jets of compressed air in the splicing chamber 11, splicing of the cut ends is completed.

Finally the spliced thread is released and all the parts of the device return to their original position.

In this case the advantage of a greater control of the thread position is obtained, while the great elasticity typical of this kind of yarns does not hinder the first interlacing, allowing the threads the necessary movement to become interlaced under the action of the compressed air.

Figure 4:
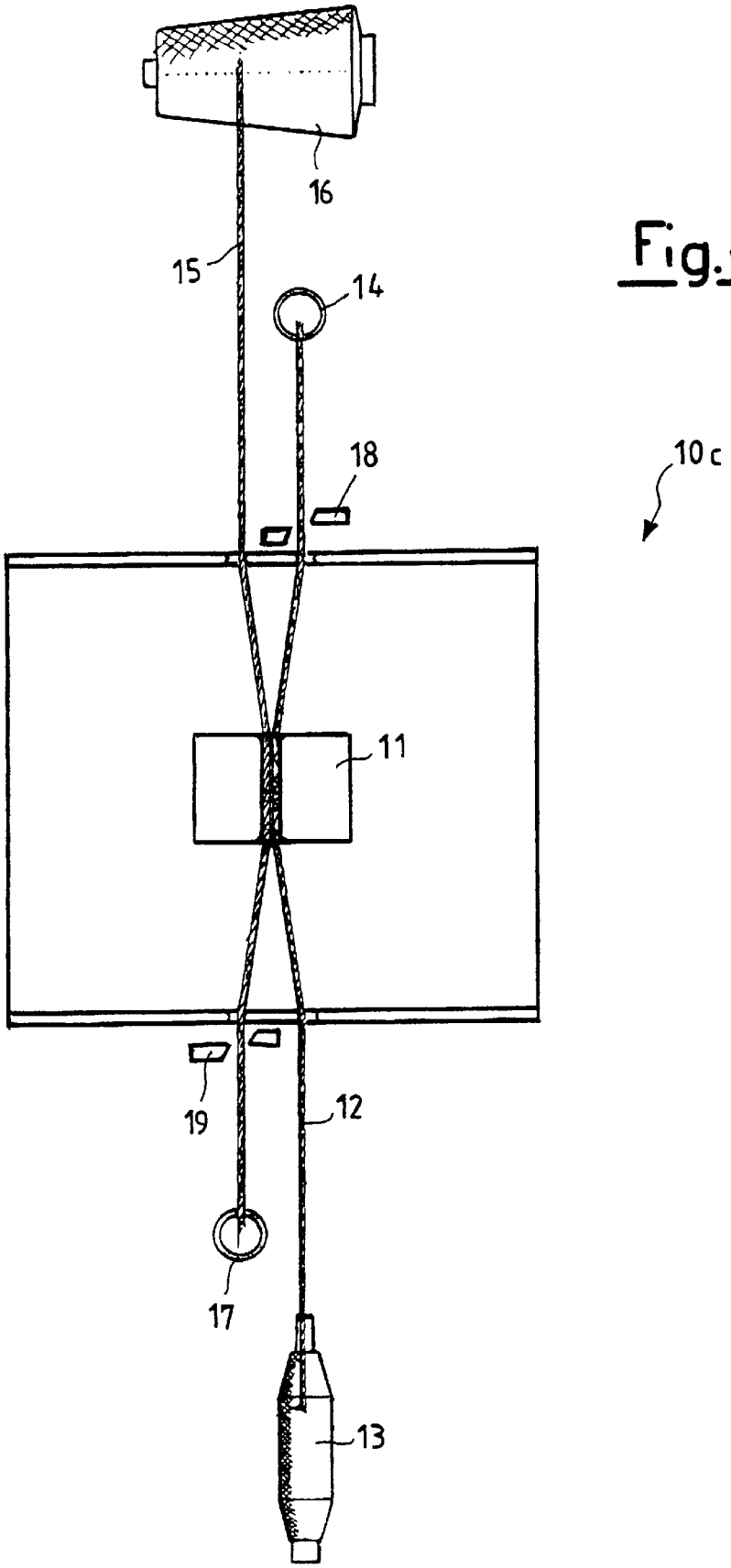
FIG. 4 shows a schematic view of a third variation of the splicing method of the invention.

FIG. 4 shows a schematic view of a third preferred variation of the splicing device in the invention, globally indicated with the reference number 10*c*.

In this device 10*c*, unlike the devices previously described, there are only the scissors 18 and 19, acting respectively on the tails of the threads 12 and 15.

The operative sequence for this third embodiment of the invention method contemplates, in sequence, the following phases: introduction of the ends of the threads 12 and 15 to be spliced in the device 10*c*, one or more jets of compressed air in the splicing chamber 11 for a first interlacing, cutting of the ends of the threads 12 and 15 by means of the scissors 18 and 19, one or more jets of compressed air in the splicing chamber 11 to complete splicing of the cut ends, and finally the release of the spliced thread with the return of all the parts of the device to their original position.

In brief, it is ascertained that, by introducing an additional clamping means and/or suitably modifying the operative sequence of the device, it is possible to obtain a splice in which the elastomers of the two ends of thread to be spliced are incorporated.

From the description given, the characteristics of the splicing device and those of the splicing method to which the present invention refers are clear, just as their advantages are clear.

In particular, the fact of incorporating both ends of the elastomer inside the spliced portions of thread allows an improvement of the overall elasticity performance of core spun thread.

Finally it is clear that numerous variations may be made to the device and to the method, object of the present invention, without straying from the principles of novelty inherent in the inventive step.

In the practical actuation of the invention, the details illustrated may have any materials, forms and dimensions, depending on requirements, and they may be replaced with others which are technically equivalent.

What is claimed is:

1. Method for the pneumatically splicing two threads or two yarns containing an elastomer, said method comprising the sequence of the following steps:

(a) introducing ends of said threads or yarns to be spliced into a splicing chamber (11), of a splicing device (10, 10*a*, 10*b*, 10*c*);

inputing compresssed air by a first input of one or more jets of compressed air into said splicing chamber (11) to cause a first interlacing of said threads or yarns;

(c) cutting the ends of said threads or yarns with scissors (18, 19), after the said first input of compressed air to form threads or yarns having cut ends;

(d) inputing into said splicing chamber (11) a second input of one or more jets of compressed air to complete the splicing of said threads or yarns having cut ends and form a spliced thread or yarn;

(e) releasing said spliced thread from said splicing device (10, 10*a*, 10*b*, 10*c*).

2. Method, according to claim 1, wherein said pneumatic splicing further comprises a clamping step wherein at least the ends of said threads or yarns to be spliced, are grasped by clamps (20, 21) after introducing said ends of said threads or yarns into said splicing chamber (11) prior to inputing one or more jets of compressed air into said splicing chamber (11) to effect a first interlacing of said threads or yarns.

3. Method, according to claim 2, wherein said clamping step comprises simultaneously clamping the ends of said threads or yarns using clamps (22, 23).

4. Device for the pneumatic splicing of two threads or two yarns containing an elastomer, said device comprising a splicing chamber (11) having one or more holes or nozzles for injecting compressed air, a pair of suction ports (14, 17), each for one of said threads or yarns to be spliced, cutting means (18, 19) for said threads or yarns comprising at least one pair of clamping means using clamps (20, 21, or 22, 23) for clamping said ends of the threads or yarns to be spliced.

5. Device for the pneumatic splicing of threads, according to claim 4, wherein an additional clamping means is employed which comprises a first clamp (22) for simultaneously clamping the end of a first thread (12) and a second thread (15), and a second clamp (23) for simultaneously clamping the end of said second thread (15) and said first thread (12).

* * * * *